US010428552B2

(12) United States Patent
Sinclair

(10) Patent No.: US 10,428,552 B2
(45) Date of Patent: Oct. 1, 2019

(54) POST ANCHOR

(71) Applicant: William Sinclair, North Ridgeville, OH (US)

(72) Inventor: William Sinclair, North Ridgeville, OH (US)

( * ) Notice: Subject to any disclaimer, the term of this patent is extended or adjusted under 35 U.S.C. 154(b) by 0 days.

(21) Appl. No.: 14/814,442

(22) Filed: Jul. 30, 2015

(65) Prior Publication Data

US 2017/0030104 A1 Feb. 2, 2017

(51) Int. Cl.
*E04H 17/22* (2006.01)
*E04H 12/22* (2006.01)

(52) U.S. Cl.
CPC ..... *E04H 17/22* (2013.01); *E04H 12/2269* (2013.01)

(58) Field of Classification Search
CPC . E04H 17/22; E04H 12/2215; E04H 12/2223; E04H 12/223
USPC ..... 52/170
See application file for complete search history.

(56) References Cited

U.S. PATENT DOCUMENTS 1,781,889 A * 11/1930 Wertzberger ..... E21B 15/00 52/298
3,691,776 A * 9/1972 Hull ..... E02D 5/54 405/232
3,703,812 A * 11/1972 Newton ..... E02D 5/54 405/244
3,762,674 A * 10/1973 Ortega ..... E02D 27/42 248/346.04
4,078,757 A * 3/1978 Waters ..... A47B 19/02 108/150
4,296,584 A * 10/1981 Lempa, Jr. ..... E04H 12/2292 52/169.13
D316,511 S * 4/1991 White, Jr. ..... D8/349
5,238,321 A * 8/1993 Jarjoura ..... A47B 57/44 256/65.03
5,363,610 A * 11/1994 Thomas ..... E04B 1/34347 52/126.6
5,595,039 A * 1/1997 Lowery ..... E04C 5/206 52/677
5,695,174 A * 12/1997 Tsai ..... E04H 12/2215 256/19
5,765,273 A * 6/1998 Mora ..... B23Q 1/03 108/4
5,816,554 A * 10/1998 McCracken ..... E04F 15/02458 248/346.01
D433,615 S * 11/2000 Neider ..... D8/354
6,151,852 A * 11/2000 Linn ..... E04H 17/163 256/24
6,279,880 B1 * 8/2001 Hawks, Jr. ..... E04G 21/3219 256/67
6,324,800 B1 * 12/2001 Valentz ..... E04D 13/12 248/346.01
D466,394 S * 12/2002 Neider ..... D8/354
(Continued)

FOREIGN PATENT DOCUMENTS

CH 479775 A * 10/1969 ..... E04H 17/22

*Primary Examiner* — Jeanette E Chapman
(74) *Attorney, Agent, or Firm* — Rankin, Hill & Clark LLP

(57) ABSTRACT

A fence component buried in the earth having a generally planar base portion, having a generally flat bottom surface and a generally ridged upper surface. The fence component includes a generally vertical support secured to the base, the support located substantially off-center of the base portion.

20 Claims, 9 Drawing Sheets

(56) References Cited

U.S. PATENT DOCUMENTS

| | | | | |
|---|---|---|---|---|
| 6,536,717 | B2 * | 3/2003 | Parker | F16L 3/1016 248/346.01 |
| 6,669,163 | B2 * | 12/2003 | Davis, Jr. | F16M 7/00 248/188.1 |
| 6,802,496 | B1 * | 10/2004 | Preta | E04H 17/1413 16/253 |
| 6,857,808 | B1 * | 2/2005 | Sugimoto | E04B 1/2403 248/903 |
| 7,048,090 | B2 * | 5/2006 | Dean | A62B 35/0056 182/3 |
| 7,553,103 | B2 * | 6/2009 | Jameson | E01F 9/608 116/63 R |
| 7,627,994 | B1 * | 12/2009 | Demirkan | E04H 12/2269 248/530 |
| 7,694,487 | B1 * | 4/2010 | Ryan | E04H 12/2269 248/156 |
| D696,835 | S * | 12/2013 | Rogerson | D99/43 |
| 8,978,328 | B2 * | 3/2015 | Albrechts | B60P 7/0869 52/165 |
| 9,127,475 | B2 * | 9/2015 | LeAnna | E04H 12/2284 |
| 9,269,282 | B1 * | 2/2016 | Hartman | G09F 7/22 |
| 9,540,783 | B2 * | 1/2017 | Lymberis | E02D 5/803 |
| 2004/0148878 | A1 * | 8/2004 | Somerville | A01G 9/122 52/165 |
| 2013/0312340 | A1 * | 11/2013 | Miller | E04H 12/22 52/169.13 |

* cited by examiner

POST ANCHOR

BACKGROUND OF THE INVENTION

Fences, including the installation of fences, can present challenges. Many fence installations employ concrete for stability. The use of concrete presents logistical and equipment requirements that can be discouraging, particularly to consumers who want to install the fence themselves. There is a long-felt need for an improved fence and fence post and means for installation thereof.

The present invention offers a number of possible advantages, such as:

1. It is comparatively inexpensive to use and/or install.
2. It is comparatively easy to use and/or install.
3. It is comparatively less time consuming to use and/or install.
4. It produces a fencing product that is comparatively portable.

SUMMARY OF THE INVENTION

The above advantages as well as other advantages not specifically enumerated are achieved by a device to support a fence post having a bottom portion and vertical support. Various advantages of this invention will become apparent to those skilled in the art from the following detailed description, when read in light of the accompanying drawings. The product may be permanently or temporarily installed.

DETAILED DESCRIPTION OF THE INVENTION

Figure 1:
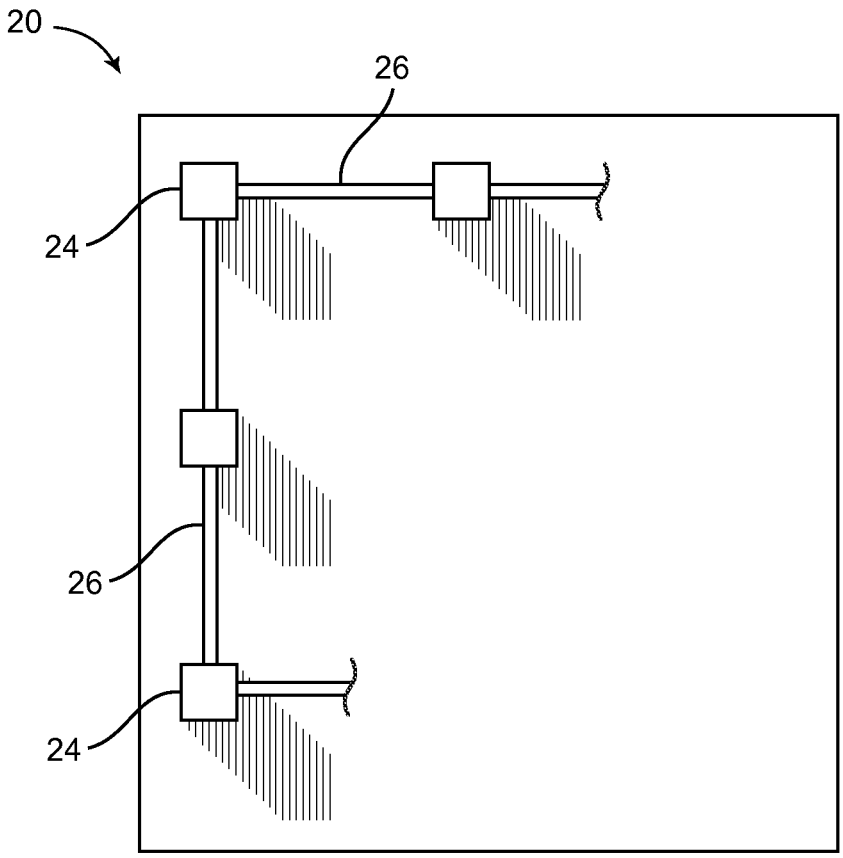
FIG. 1 is a plan view of a fence according to the invention.
Figure 2:
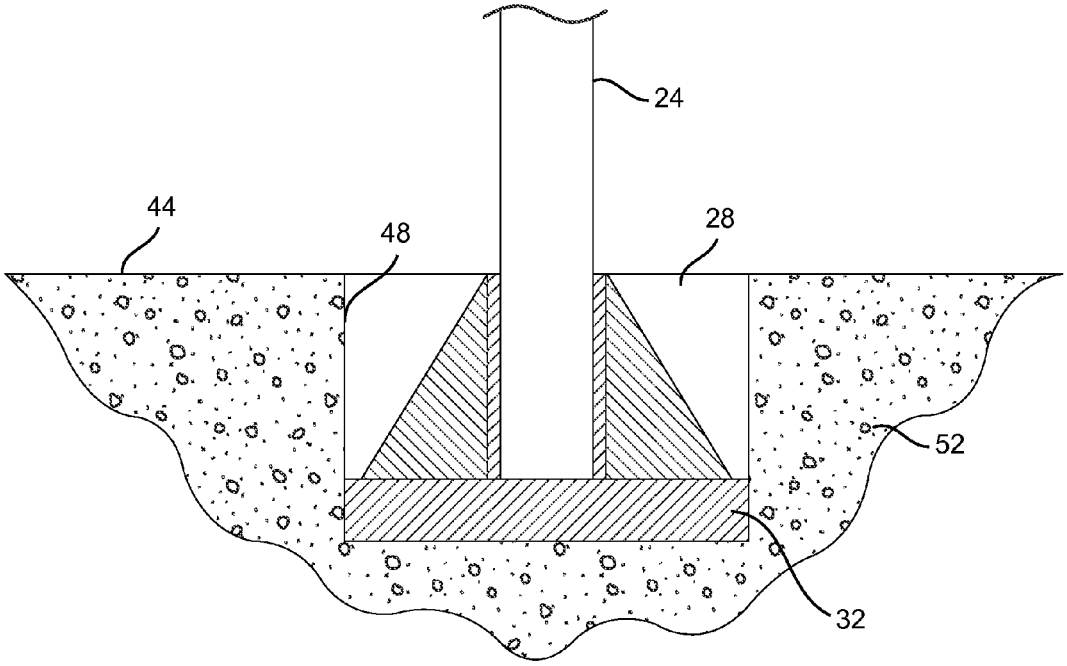
FIG. 2 is a cross-sectional view in elevation of a hole and a post anchor according to the invention.
Figure 3:
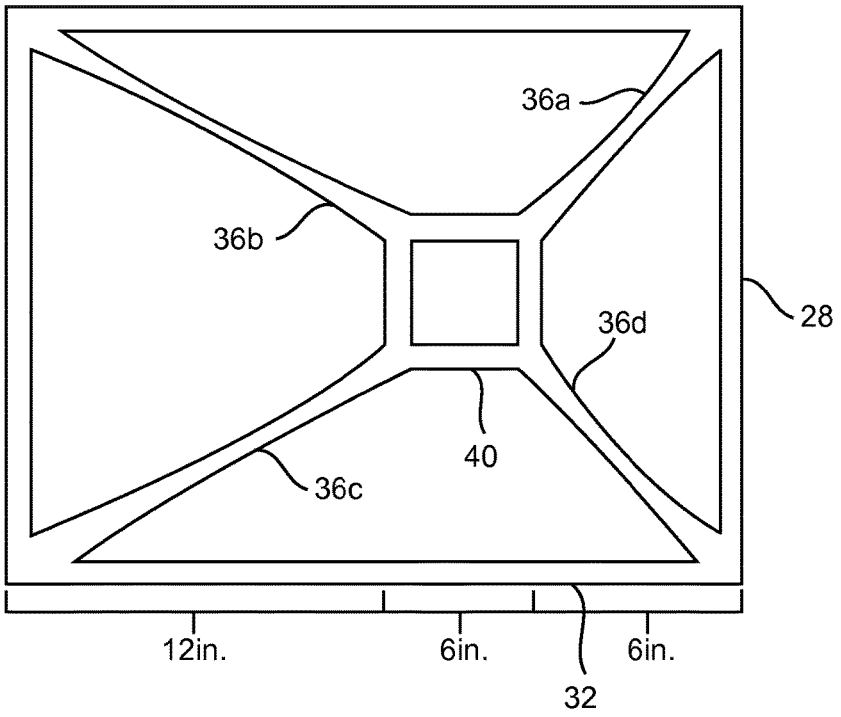
FIG. 3 is a plan top view of an offset post anchor according to the invention.

Preliminarily, it should be noted that certain terms used herein, such as for example "left", "right", "top", and "bottom", are used to facilitate the description of the invention. Unless otherwise specified or made apparent by the context of the discussion, such terms and other directional terms should be interpreted with reference to the figure(s) under discussion. Such terms are not intended as a limitation on the position in which the invention or components may be used. Indeed, it is contemplated that the components of the invention may be easily positioned in any desired orientation for use. Likewise, numerical terms such as for example "first", and "second" are not intended as a limitation or to imply a sequence, unless otherwise specified or made apparent by the context of the discussion. While the drawings may include numerical indications of size, they should not be regarded as limitations on the invention sizes or proportions.

Referring to the figures, there is shown a fence 20. The illustrated fence includes a plurality of posts 24 and rails 26. The posts 24 are generally vertical members. The rails 26 are generally horizontal members. The posts 24 and rails 26 are operatively connected. The posts 24 and rails 26 may be secured in any suitable fashion. The posts 24 are bearings for the rails 26. The posts 24 may be positioned in a corner type configuration, an in-line type configuration, or any other suitable configuration. It will be appreciated that the post may be provided to support any suitable structure or portion thereof. For example the post may be provided to support a mailbox, gazebo, porch, and the like. Though some of the aspects of the structures of the figures may not necessarily be identical, numerical reference characters suggesting a similarity are employed. The post 24 shown is generally squared. It may be generally circular or rounded or any suitable shape as desired.

The post 24 may be supported by an anchor 28. The illustrated anchor 28 may be viewed as a boot for the post 24. The term "anchor" is understood to include any suitable structure of means of providing something that serves to hold something firmly or provide stability. The term "boot" is understood to include any suitable structure of means of providing a casing or fitted covering and/or support.

The illustrated anchor 28 includes a base 32, a plurality of wings 36 *a, b, c, d* and a sleeve 40. The term "wing" is understood to include any suitable part or feature usually projecting from and subordinate to a main and/or central part. The illustrated wings 36 *a, b, c, d* project from the base 32. The illustrated wings 36 *a, b, c, d* are generally upwardly sloping members, though any suitable configuration may be employed. For example, the wings could be generally straight and slope upwardly from the base 32. Though four wings are shown, any suitable number may be employed. The illustrated wings are positioned generally between the corners of the base 32 and the sleeve 40. The wings may be positioned in any suitable manner, such as for example generally from the four sides of the base 32—or otherwise.

The illustrated sleeve 40 is generally squared to accommodate a generally squared post 24. The term "sleeve" is understood to include any suitable generally tubular part designed to fit over and/or generally around another part. The sleeve may generally sustain and/or steady another part, and/or form a connection between two parts. The illustrated sleeve 40 is preferably adapted to receive a post 24 therein. The illustrated sleeve 40 may be thought of as a type of seat for the post 24. The sleeve 40 may have any suitable number of sides or may be generally rounded or have generally rounded portions. The illustrated anchor 28 shows the sleeve 40 positioned generally slightly off-center as shown.

It will be appreciated that the illustrated anchor 28 is shown substantially beneath the ground line 44 and positioned in a hole 48 in the ground. In the hole 48, the anchor is a device buried in the earth. The profile of the hole 48 should be generally level and generally accommodate the shape and profile of the base 32. The hole 48 may not need to be as deep as with prior art fence components, in part due to the lack of need to use concrete for stability.

The hole 48 may be dug or created by any suitable means. The term "hole" as used here is understood to include any hollowed-out place, cave, pit, opening, or well in the ground or other suitable medium. It will be noted that the top portion of the illustrated sleeve 40 extends slightly above the ground line 44.

That portion of the anchor 28 which is beneath the ground line 44 may be generally covered with a suitable fill material 52. A wide variety of fill materials may be employed. By way of example, the fill material may include dirt, soil, sand, rock, gravel, and the like. The bottom portion of the base 32 is shown in substantial contact with the bottom of the hole 48.

The invention may be employed with any suitable type of fencing, including picket fencing, privacy fencing, and ornamental, as well as others. The materials used may include vinyl or any other suitable material. Comparatively lightweight materials facilitate the portability of the fence components.

Alternate embodiments may be employed. For example, referring now to FIGS. 5 and 6, the illustrated anchor 128 includes a base 132, a plurality of wings 136 *a, b, c, d* and a sleeve 140. The illustrated wings 136 *a, b, c, d* project from the base 132. The illustrated wings 136 *a, b, c, d* are generally upwardly sloping members, though any suitable configuration may be employed. The illustrated wings are positioned generally between the corners of the base 132 and the sleeve 140. The wings may be positioned in any suitable manner, such as for example generally from the four sides of the base 132—or otherwise.

Figure 4:
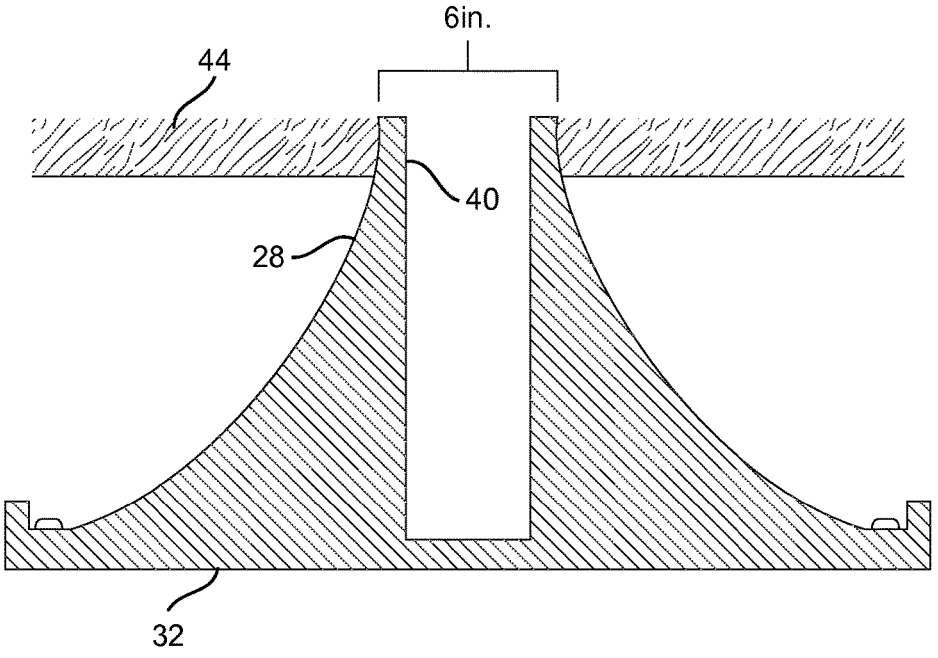
FIG. 4 is a cross-sectional view in elevation of the post anchor of FIG. 3.
Figure 5:
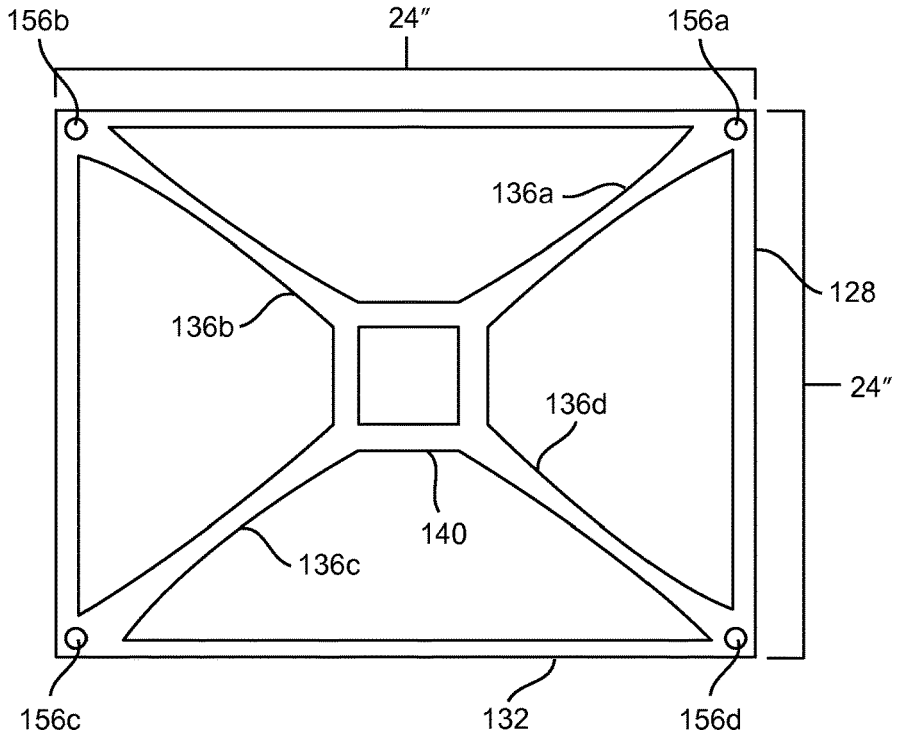
FIG. 5 is a plan top view of a post anchor with a screw attachment according to the invention.
Figure 6:
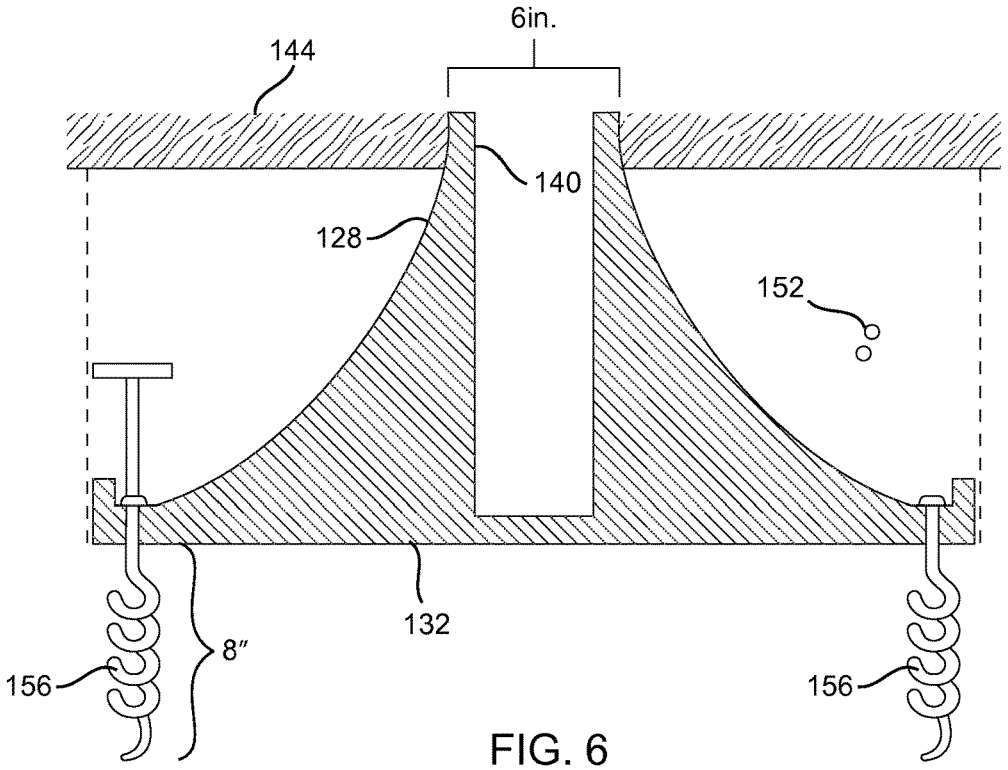
FIG. 6 is a cross-sectional view in elevation of the post anchor of FIG. 5.
Figure 7:
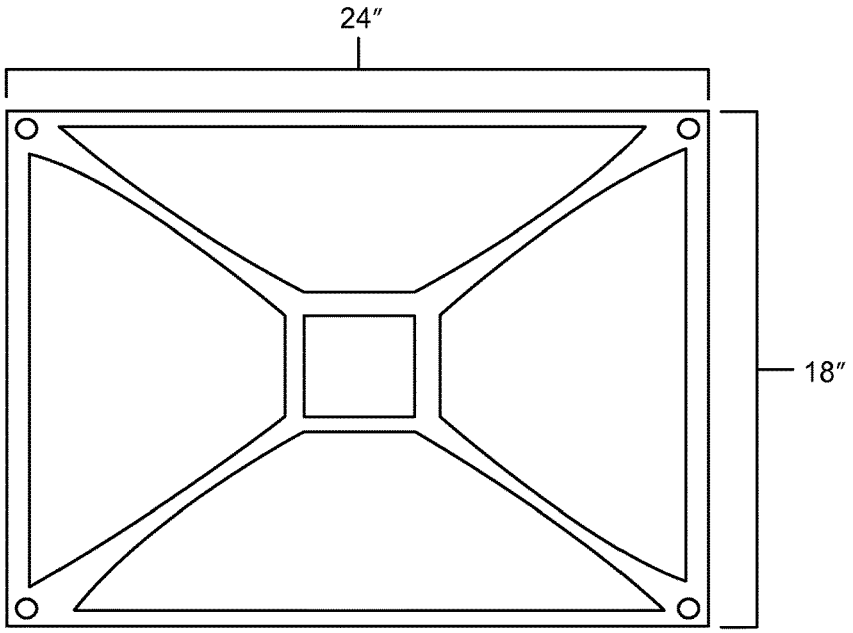
FIG. 7 is a plan top view of an offset post anchor with a screw attachment according to the invention.
Figure 8:
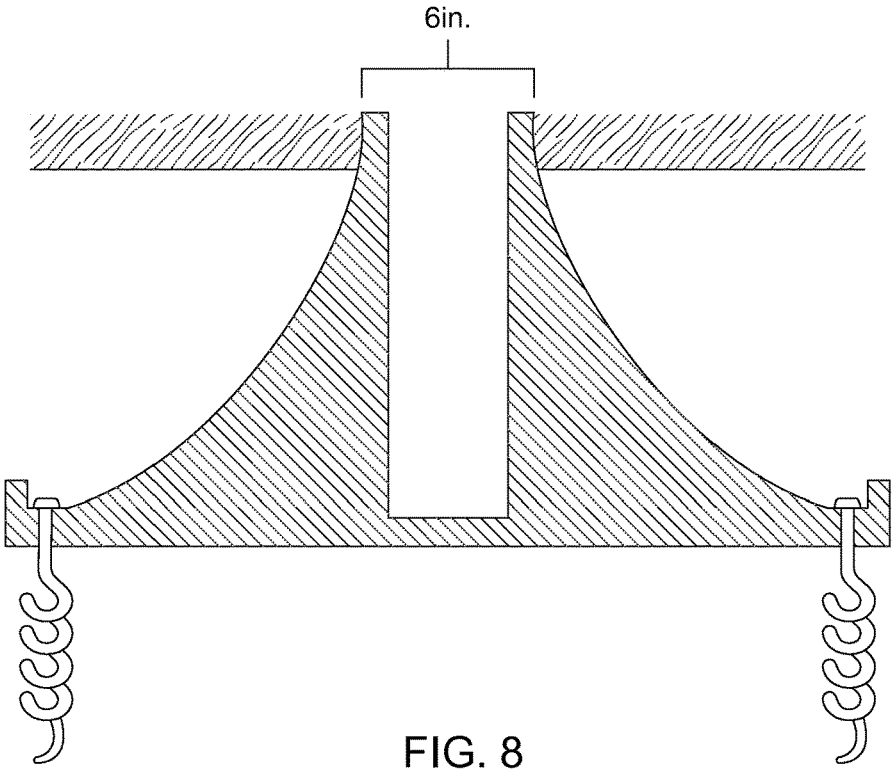
FIG. 8 is a cross-sectional view in elevation of the post anchor of FIG. 7.

The illustrated sleeve 140 is generally squared to accommodate a generally squared post 24. The sleeve 140 is preferably adapted to receive a post 24 therein. The illustrated sleeve 140 may be thought of as a type of seat for the post 24. The sleeve 140 may have any suitable number of sides or may be generally rounded or have generally rounded portions. The illustrated anchor 128 shows the sleeve 140 positioned generally centered as shown in FIGS. 4 and 5.

It will be appreciated that the illustrated anchor 128 is shown substantially beneath the ground line 144 and positioned in a hole 148 in the ground. The hole 148 may be dug or created by any suitable means. It will be noted that the top portion of the illustrated sleeve 140 extends slightly above the ground line 144. That portion of the anchor 128 which is beneath the ground line 144 may be generally covered with a suitable fill material 152. The bottom portion of the base 132 is shown in substantial contact with the bottom of the hole 148.

The anchor 128 may also include any suitable number of stabilizers. The illustrated stabilizers 156 *a, b, c, d* are downwardly extending rod-shaped pieces, each with a spiral groove. The stabilizers may include a slotted or recessed head portion to facilitate rotation and downward penetration into the hole 148. The illustrated stabilizers are designed to be inserted into material by rotation. A handle (not shown) may be employed with the stabilizers to facilitate insertion into the hole 148.

A new method is contemplated in accordance with the present invention, particularly when compared to the option of installing fencing products with concrete and the like. The present invention allows for the use of a comparatively smaller hole for use with the anchor and post. The comparatively smaller hole may include a comparatively less deep and/or wide hole. The hole may be any suitable shape, such as for example generally rounded, squared and/or angled as desired. Filling material, such as readily available fill dirt from the hole may be employed in lieu of concrete.

Figure 9:
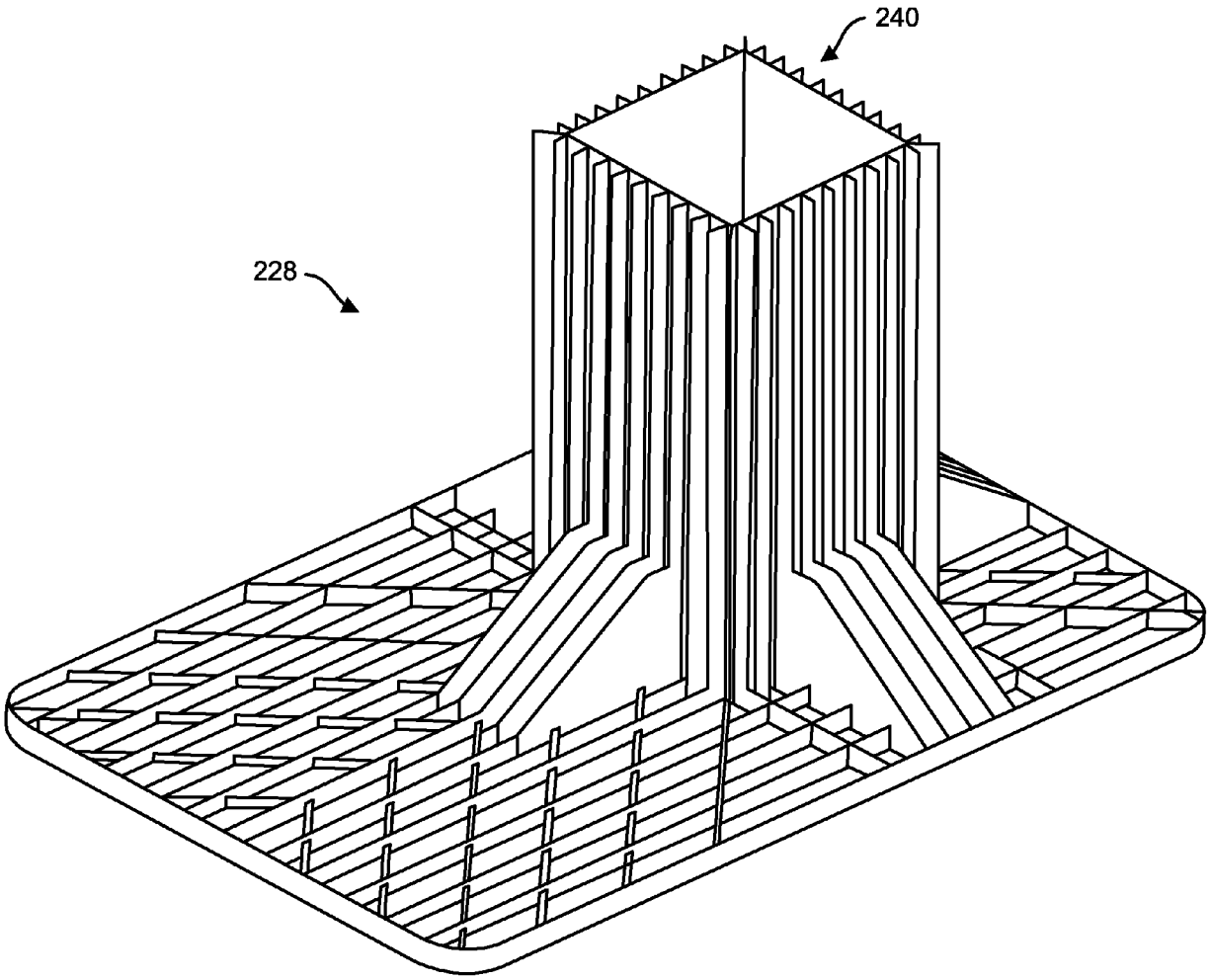
FIG. 9 is an elevation perspective view of an alternate embodiment of a post anchor according to the invention.
Figure 10:
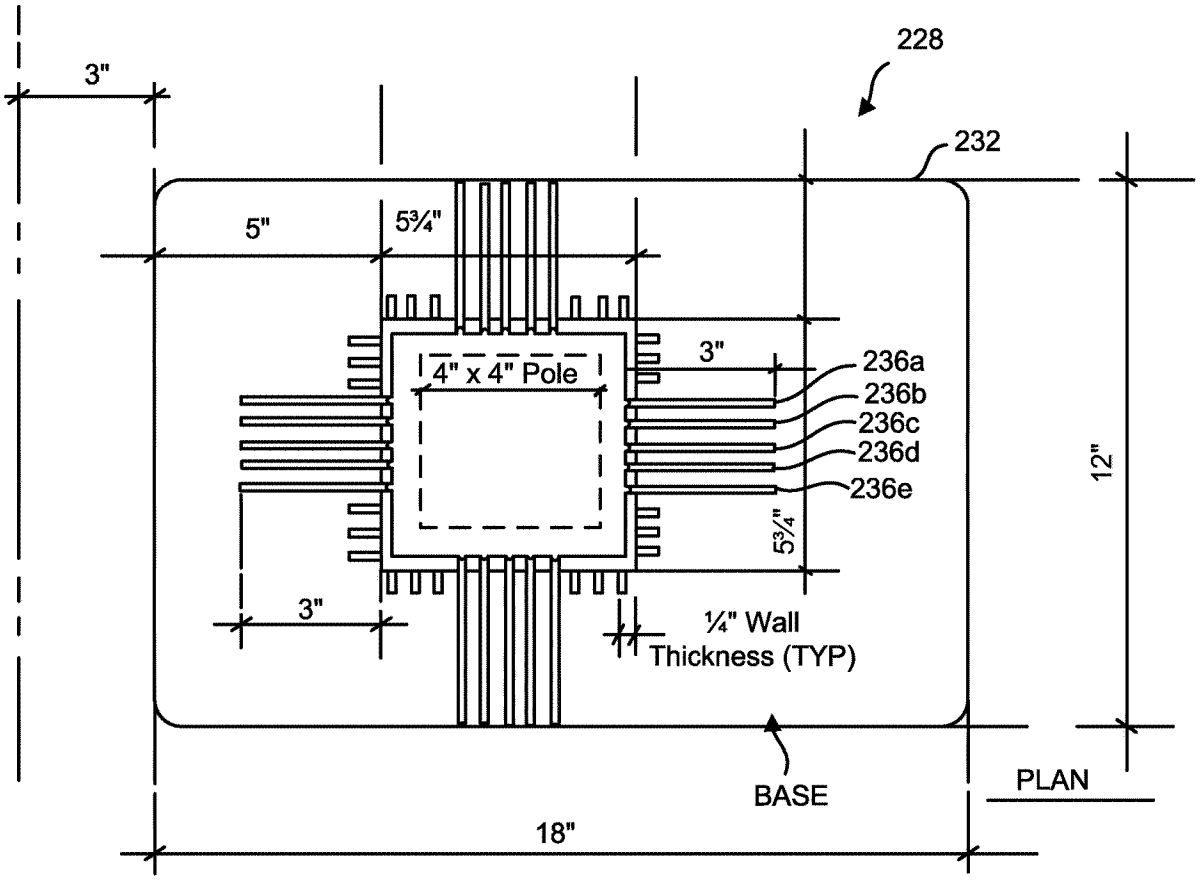
FIG. 10 is a simplified view in elevation of the post anchor of FIG. 9.
Figure 11:
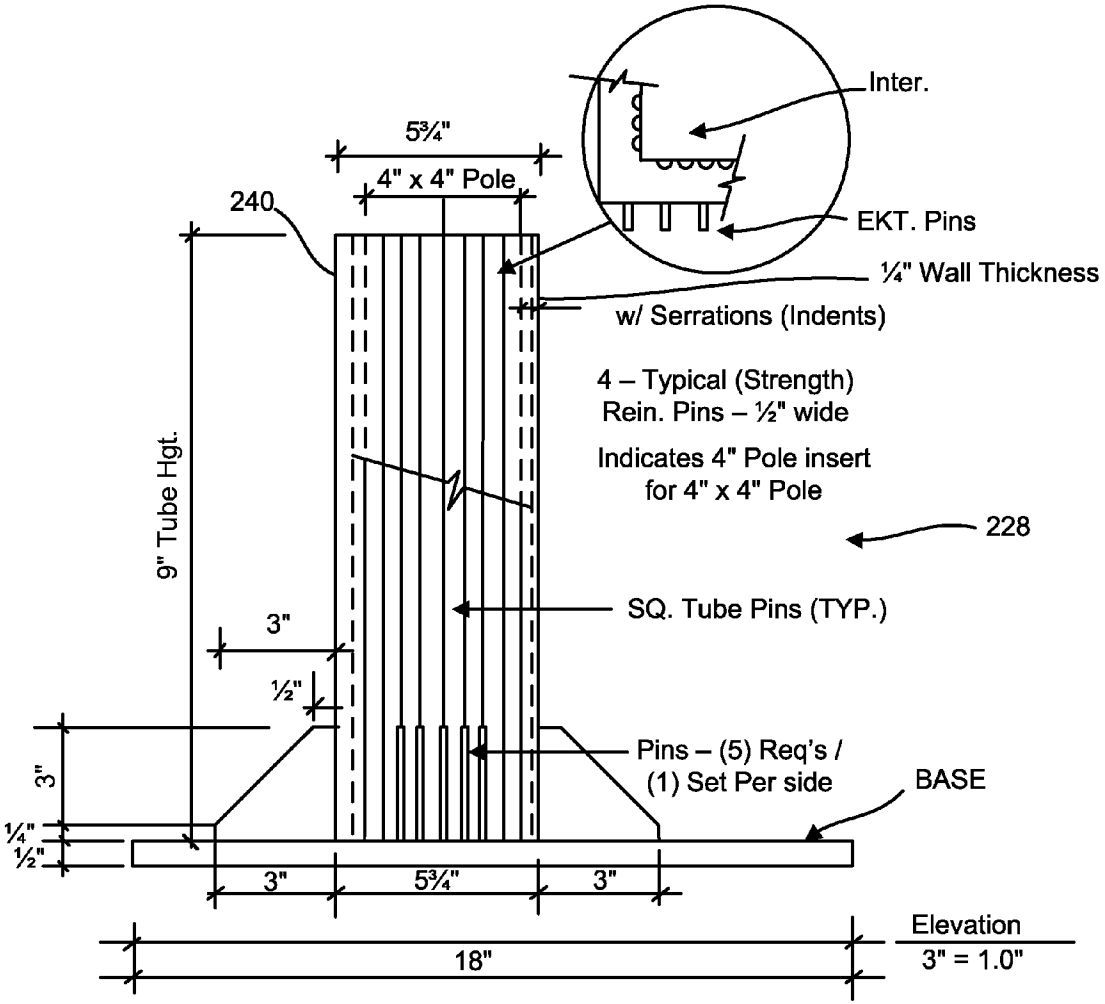
FIG. 11 is a simplified plan top view of the post anchor of FIG. 9.

Referring now to FIGS. 9, 10, and 11, alternate embodiments of the post anchor may be provided. The illustrated anchor 228 includes a base 232, a plurality of wings 236 *a, b, c, d, e* and a sleeve 240. The sleeve 240 is a vertical support. For purposes of clarity and to facilitate comprehension, five wings 236 *a, b, c, d, e* are labelled, though twenty are shown. As best appreciated from FIG. 11, there are four sets of five wings for each of the four sides of the anchor 228, as shown. The configuration and number of wings may be altered as desired to optimize performance. The wings are an optional feature.

The sleeve 240 is shown generally offset from the center of the base 232. This allows the sleeve 240 of the anchor 228, and thus the fence post supported by the sleeve 240, to be located relatively nearer to a desired location, such as a property line or boundary of a portion of land. When the fence component is a gate post, the base 232 of the anchor 228 may be generally rounded or generally circular.

The anchor can be made in a wide variety of sizes and shapes, as required by installation, design and aesthetic requirements. The anchor 228 shown, as merely one example, includes a base 232 which is eighteen inches long by twelve inches wide. The four corners of the base 232 are shown generally rounded. The ratio of the length of the base 232 to the width of the base 232 is within the range of from about 16 to 12 to about 24 to 12. In other words, the ratio of the length of the base 232 to the width of the base 232 is about 4 to 3 or about 2 to 1. The sleeve 240 is shown about in the center of the width dimension of the base 232 and off-center of the length dimension of the base 232. While the exact dimensions may vary, the ratios or comparative measures offer an important advantage. The advantage of a more stable anchor 228 offer a particular advantage in the absence of concrete or similar hardening material. The stable base 232 allows for optimal sleeve 240 positioning to better support the level fence desired.

The anchor 228 shown is adapted to support a fence post extending approximately four inches by four inches square. The walls of the generally square sleeve 240 are approximately one quarter of an inch in thickness. The sleeve 240 is substantially perpendicular to the base 232 of the anchor 228. The base 232 of the anchor 228 shown is approximately one half of an inch in thickness, the bottom surface being substantially flat. The inner dimension of the walls of the sleeve 240 shown accept a fence post extending approximately four inches by four inches square. The sleeve 240 shown extends approximately nine inches from the base 232 of the anchor 228.

The exterior surfaces of each of the four sides of the sleeve 240 shown includes eleven perpendicular ridges extending the approximately nine inch height of the sleeve 240. The term "ridge" is understood to include but is not limited to a generally narrow, raised strip. It will also be appreciated that the interior surfaces of each of the four sides of the sleeve 240 includes grooves or ridge. The term "groove" as used in this context includes a structure which is generally a long narrow channel or depression. Without wishing to be bound by theory, the grooves and ridges on the sleeve 240 are thought to provide a means for glue or adhesive, if used, to better affix the sleeve 240 to the fence post 24. The groves or ridges may also provide for some measure of moisture drainage or displacement.

The fence post 24 may rest on the base 232 of the anchor 228. The fence post 24 may rest on any portion of the wings 236 *a, b, c, d, e* of the anchor 228, particularly on the uppermost portion of the wings 236 *a, b, c, d, e* extending generally perpendicular to the sleeve 240. In one matter of installing the fence, the fence post 24 may be located at a desired position, then held in placed by a screw or clamp until a glue or suitable adhesive can bare the weight of the fence post 24.

Each of the four sides of the sleeve 240 shown includes five wings 236 *a, b, c, d, e*. Five of the ridges on each of the four sides are wings. Each series of five wings are shown flanked laterally by two sets of three perpendicular ridges. The outer dimension of the sleeve 240 shown is approximately five and three fourths inches, excluding the dimension of the perpendicular ridges. The upper surface of the base 232 shown is somewhat channeled or corrugated, allowing the upper surface of the base 232 to increase contact with dirt or file material on top of the base 232.

The wings 236 *a, b, c, d, e* extend at an approximately 45 degree angle from the sleeve 240 and the base 232. The upper-most portion of the wings 236 *a, b, c, d, e* extends generally perpendicular approximately one-half inch from the sleeve 240. The lower-most portion of the wings 236 *a, b, c, d, e* extends approximately perpendicular one-fourth inch from the upper surface of the base 232 of the anchor 228. Like the other dimensions discussed for the drawing under consideration, these distances are subject to vary. The wings 236 *a, b, c, d, e* serve a number of functional purposes, including mitigating lateral forces on the vertical support.

The wings 236 *a, b, c, d, e* extend perpendicular from the outer wall of the sleeve 240 approximately three inches. The wings 236 *a, b, c, d, e* extend perpendicular from the upper surface of the base 232 approximately three inches. One outer wall of the sleeve 240 is approximately 5 inches from the edge of the width of the base 232, the width having a dimension of approximately 12 inches as shown. One outer wall of the sleeve 240 is located approximately 7 and ¼ inches from the edge at the other end of the width of the base 232 of the anchor 228.

The generally off-center vertical support sleeve 240 allows the boot, or anchor 228, to be placed relatively closer to a property line or other desired geographical location than if the sleeve 240 was centered along the length dimension of the base 232. For the illustrated anchor 228, the vertical support sleeve 240 may be located approximately three inches from the property line, as desired.

In operation, erecting a fence in accord with the present anchor invention offers a number of advantages. The primary advantages derive from the ability to use readily available dirt or soil to fill the hole dug to contain the anchor. Concrete would otherwise be needed to keep the anchor and fence post stable and generally immobile, and the hole would have to be substantially deeper for concrete to hold. Filling the hole with dirt after the anchor is deposited and leveled, and the fence post is in the desired position and set in a generally vertical orientation, provides sufficient weight to maintain the anchor and fence post stable and generally immobile. Thus, most fence installations can be accomplished with common shovels and/or post-hole diggers. Once the hole is placed, the leveled anchor and fence post are placed, the hole is then filled with dirt. The dirt covering the anchor can similarly be removed, allowing the fence post and anchor to be removed. In operation, the dirt covers the upper surface of the base of the anchor while the lower surface of the base of the anchor is placed generally flat and level in the hole.

Without wishing to be bound by theory, the new method is thought to possibly provide a benefit by way of suction. The term "suction" as used herein is understood to include any suitable type or number of acts or process of exerting a force upon a solid, liquid, or gaseous body by reason of reduced air or other pressure over part of its surface. The bottommost portion of the post anchor is believed to be held in a relatively stable orientation in some measure due to a suction force of the moisture proximate the bottom portion of the post anchor. As applied, the suction may generally attract or pull the bottom surface and/or bottom portion of the base of the anchor toward the bottom of the hole. The suction may benefit from moisture and/or water in or with the fill material in and/or around the hole and/or fencing components. Grass, or other suitable ground cover, may also be used to cover the hole once the anchor and/or post is positioned as desired and the hole is filled with one or more fill material(s).

Since the sleeve 240 shown is generally hollow, it serves as a sort of weep hole, allowing moisture from the atmosphere, weather, and soil to generally settle to and under the base 232 of the anchor 228. It is believed that the moisture further assists in the suction, holding the base 232 of the anchor 228 in place. Further, the base 232 may define one or more openings to allow generally downward migration of moisture.

An optional size reducer (not shown) may be employed in a fence installation assembly as desired. To illustrate how a reducer may be beneficial, consider that the inner dimension of the squared sleeve 240 is approximately four inches. Suppose that the fence design calls for a squared fence post 24 approximately three inches. Without a reducer, this leaves about one inch of play, leeway or slack within which the fence post 24 can move. It is preferable for the fence post 24 to be held in a generally sturdy fashion, and reduce or eliminate slack or movement of the fence post 24.

The base 232 of the anchor 228 allows the one or more hole(s) 48 to be relatively less deep compared to prior-art fence installations. One reason for this relatively shallower hole 48 is concrete is no longer needed. Instead, the suction under the base 232 of the anchor 228 and the dirt and fill material on top of the base 232 of the anchor 228 serve to hold the anchor 228 and fence post 24 stable without use of concrete. Shallower hole(s) 48 further leads to fewer incidents of digging into electrical lines or other utility components. A hole of approximately twelve inches deep will generally suffice for most fence installations employing the invention as illustrated.

Figure 12:
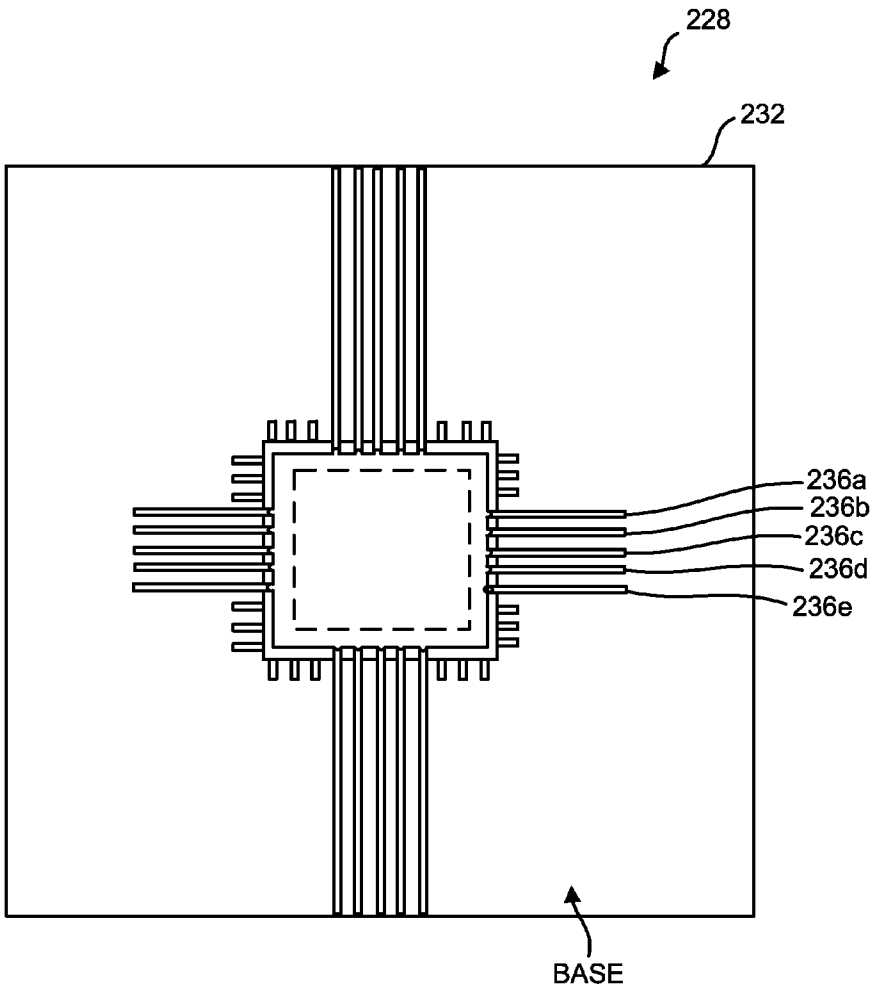
FIG. 12 is an alternate embodiment of the post anchor.

Referring now to FIG. 12 an alternate embodiment of the post anchor is shown. Notice that the base is generally squared. The base may take on a wide variety of shapes. The base may be generally rounded, oval or any suitable polygon shape as desired.

Enhanced portability of the fence components may offer an advantage to the user. When the hole is not filled with concrete, the fill material may be removed from the hole with comparative ease. This allows the fence components to be more easily removed from the hole. The fence components can then be moved to a more desirable location. It will be appreciated that a relatively portable fence is thus producible in accordance with the present invention.

The invention may be made from any suitable material and by any suitable method. The invention may be adapted to fit a wide variety of uses. It will be appreciated that the components of the invention may be easily modified as needed to accommodate varying sizes and shapes. It is to be understood that the invention is not limited in its application to the details of construction and to the arrangements of the components set forth in the accompanying description or illustrated in the drawings. The invention is capable of other embodiments and of being practiced and carried out in various ways. Also, it is to be understood that the phraseology and terminology employed herein are for the purpose of description and should not be regarded as limiting. The disclosure may readily be utilized as a basis for the designing of other structures, methods and systems for carrying out the present invention. It is important, therefore, that the claims be regarded as including equivalent constructions. Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract and disclosure are neither intended to define the invention of the application, which is measured by the claims, nor are they intended to be limiting as to the scope of the invention in any way.

What is claimed is:

1. A post anchor configured to be buried in a hole in the ground and to support a fence post in a vertical orientation in the hole and to maintain the fence post in the vertical orientation in the hole, comprising:

a bottom-most generally planar base portion having a substantially flat bottom surface with no attachments or projections, and an upper surface, the bottom surface configured to contact a bottom of an associated hole in the ground, a hollow tubular sleeve, a bottom-most edge of the sleeve contacting and adjoined to the upper surface of the base portion, the sleeve extending substantially perpendicular up from the upper surface of the base portion, the sleeve being configured to receive a portion of an associated 4×4 fence post therein such that the associated fence post rests on the upper surface of the base portion, and a plurality of wings extending between the upper surface of the base portion and an outer surface of the sleeve, wherein the base portion has a length and a width;

wherein the sleeve contacts and connects to the upper surface of the base portion at a location substantially off-center of the upper surface of the base portion; and wherein the location is centered at 37.50%-43.75% of the length.

2. The post anchor according to claim 1, wherein the upper surface of the base portion is corrugated.

3. The post anchor according to claim 1, wherein the base portion has a square shape or a rectangle shape and includes four corners.

4. The post anchor according to claim 3, wherein one wing extends between each corner of the base portion and the sleeve.

5. The post anchor according to claim 1, wherein the sleeve has a substantially square cross-sectional shape and consists of four sides and four corners.

6. The post anchor according to claim 5, wherein at least one wing extends between each side of the sleeve and the base portion.

7. The post anchor according to claim 5, wherein five wings extend between each side of the sleeve and the base portion.

8. The post anchor according to claim 5, wherein:

the base portion has a square shape or a rectangle shape and includes four corners; and one wing extends between each corner of the base portion and a corner of the sleeve.

9. The post anchor according to claim 1, wherein the plurality of wings slope up from the upper surface of the base portion.

10. The post anchor according to claim 9, wherein the wings slope at an approximately 45 degree angle from the sleeve and from the base portion.

11. The post anchor according to claim 1, wherein:

the sleeve includes an inner surface defining a plurality of grooves extending substantially perpendicular to the upper surface of the base portion, and the outer surface of the sleeve includes a plurality of ridges extending substantially perpendicular to the upper surface of the base portion.

12. The post anchor according to claim 1, further including stabilizers comprising a spiral groove and extending from the bottom surface of the base portion, the stabilizers being configured to be inserted into the ground by rotation.

13. The post anchor according to claim 12, wherein the stabilizers include a slotted head portion or a handle configured to rotate the stabilizers.

14. The post anchor according to claim 12, wherein:

the base portion has a square shape or a rectangle shape, and one of the stabilizers is located at each corner of the base portion.

15. A fence comprising a plurality of substantially vertical posts extending up from the ground, a plurality of rails, and a plurality of post anchors buried in holes in the ground, wherein at least one rail extends between adjacent posts;

wherein each post anchor supports one post and comprises:

a bottom-most generally planar base portion having a substantially flat bottom surface with no attachments or projections, and an upper surface, the flat bottom surface contacting a bottom of the hole, a hollow tubular sleeve, a bottom-most edge of the sleeve contacting and adjoined to the upper surface of the base portion, the sleeve extending substantially perpendicular up from the upper surface of the base portion, and a plurality of wings extending between the upper surface of the base portion and an outer surface of the sleeve;

wherein the upper surface of the base portion is covered with fill material that is not concrete and only a top portion of the sleeve extends above the ground;

wherein a portion of one post is received inside the sleeve and rests on the upper surface of the base;

wherein the base portion has a length and a width;

wherein the sleeve contacts and connects to the upper surface of the base portion at a location substantially off-center of the base portion; and wherein the location is centered at 37.50%-43.75% of the length.

16. The fence according to claim 15, wherein:

the base portion has a square shape or a rectangle shape and includes four corners, the sleeve has a substantially square cross-sectional shape and includes four sides and four corners, and one wing extends between each corner of the base portion and a corner of the sleeve.

17. The fence according to claim 15, wherein:

the sleeve has a substantially square cross-sectional shape and includes four sides and four corners, and at least one wing extends between each side of the sleeve and the base portion.

18. The post anchor according to claim 1, wherein the length and the width that are each larger than a height of the sleeve.

19. The post anchor according to claim 1, wherein a height of the sleeve is from 9 to 11.5 inches.

20. The fence according to claim 15, wherein the length and the width that are each larger than a height of the sleeve.

* * * * *